US007788829B2

(12) United States Patent
Stephan

(10) Patent No.: US 7,788,829 B2
(45) Date of Patent: Sep. 7, 2010

(54) SNOW PUSHER

(76) Inventor: Michael Stephan, 30620 Regal Ave., Shafer, MN (US) 55074

( * ) Notice: Subject to any disclaimer, the term of this patent is extended or adjusted under 35 U.S.C. 154(b) by 0 days.

(21) Appl. No.: 12/623,113

(22) Filed: Nov. 20, 2009

(65) Prior Publication Data

US 2010/0064555 A1 Mar. 18, 2010

Related U.S. Application Data

(62) Division of application No. 11/623,854, filed on Jan. 17, 2007, now Pat. No. 7,654,016.

(60) Provisional application No. 60/766,469, filed on Jan. 20, 2006.

(51) Int. Cl.
*E01H 5/06* (2006.01)

(52) U.S. Cl. ..... 37/231; 172/273

(58) Field of Classification Search ..... 37/231–234, 37/266, 268, 270–274; 172/272–275, 811
See application file for complete search history.

(56) References Cited

U.S. PATENT DOCUMENTS

| | | | |
|---|---|---|---|
| 3,410,008 | A | 11/1968 | Standfuss |
| 4,145,825 | A | 3/1979 | Bertolino |
| 4,275,514 | A | 6/1981 | Maura |
| 4,707,936 | A | 11/1987 | Steinhoff |
| 4,741,116 | A | 5/1988 | Engle et al. |
| 4,890,400 | A | 1/1990 | Long |
| 4,962,600 | A | 10/1990 | Zellaha et al. |
| 5,129,169 | A | 7/1992 | Aubichon |
| 5,435,082 | A | 7/1995 | Frenette et al. |
| 5,599,135 | A | 2/1997 | Delaurenti |
| 6,112,438 | A | 9/2000 | Weagley |
| 6,240,660 | B1 | 6/2001 | Dugas |
| 7,360,327 | B2 | 4/2008 | Osgood et al. |
| 2005/0126051 | A1 | 6/2005 | Fatemi |

*Primary Examiner*—Robert E Pezzuto
(74) *Attorney, Agent, or Firm*—Nikolai & Mersereau P.A.; C. G. Mersereau

(57) ABSTRACT

A snow pusher attachment for use in conjunction with a straight blade angle-type snow plow mounted to a work vehicle. This pusher allows a work vehicle to capture, contain, and relocate large amounts of snow very quickly and efficiently. The attachment consists of side panels, connected by horizontal members between. This pusher attachment is secured to the snow plow by bracket assemblies, attached to the upper edge of the snow plow that engage hooks on the upper, rear portion of the pusher attachment. The attachment does not require the operator to exit the work vehicle to secure or release it from the snowplow. Accordingly, the attachment allows the quick and repeated conversion of a snow plow into a snow pusher box and visa versa.

15 Claims, 6 Drawing Sheets

SNOW PUSHER

CROSS-REFERENCE TO RELATED APPLICATIONS

This application is a Divisional Application of U.S. patent application Ser. No. 11/623,854, filed Jan. 17, 2007, now U.S. Pat. No. 7,654,016, which and claims the benefit of U.S. Provisional Application No. 60/766,469, filed Jan. 20, 2006, which is hereby incorporated herein by reference in its entirety.

BACKGROUND OF THE INVENTION

I. Field of the Invention

This invention relates generally to apparatus for use in snow removal and management, and more particularly to a snow pusher which allows increased accumulation of snow in front of a snow plow during operation while inhibiting lateral spillage of snow from the ends of the plow.

II. Discussion of the Prior Art

In the past, the standard implement used on work vehicles in the snow removal industry has been a straight blade, angle-type plow. This type of implement is extremely useful in clearing surfaces by primarily displacing snow laterally a short distance to one side of the blade. However, in certain situations it is advantageous to move larger amounts of snow a greater distance and to move it forward rather than sideways. This is especially true when areas designated for snow storage are not directly adjacent to the areas being plowed. Plowing a road or other surface that is contiguous to intersecting private driveways is an example of this type of situation. Once the snow on a road or other surface has been angle-plowed to a location close to the intersecting driveways, it is desirable to capture, contain, and relocate the plowed snow rather than to leave a windrow of snow at the entrance to each intersecting driveway.

To accomplish this type of task persons previously have used devices which primarily push snow forward. These devices are generally vehicles with containment members having forward facing openings which are mounted to the front of work vehicles. Existing snow pusher devices typically make use of some type of forwardly projecting panels on their sides to help prevent spillage of snow from either end of the plow and thereby to allow a greater amount of snow to be contained and transported to a desired location. Specifically, some previous attempts at capturing and containing plowed snow include pusher box designs, immobile or slightly mobile sides attached to a straight blade plow, and powered V shaped plows.

Pusher boxes are forward facing attachments which are joined to the front of work vehicles. While these boxes do provide an enhanced ability to relocate large amounts of snow, there are many drawbacks. First, these pusher boxes have the disadvantage of being stationary and non-angling. Therefore, the pusher box can only relocate snow forward in the direction of the vehicle's travel and cannot "plow" snow laterally across a surface. Second, this type of device is not designed to be convertible between plowing and pushing operations. For most snow removal jobs, in order to effectively remove snow from a given area a pusher box device could not be used exclusively. Therefore, a pusher box device would need to be used in close connection with a work vehicle equipped with some type of plow blade. Because these pusher boxes are not adapted to convert between plowing and pushing devices, multiple vehicles would be required to complete snow removal from a given site.

Other devices used in the past utilize immobile or slightly mobile sides attached to a straight blade plow. These devices generally have metal plates that bolt or attach to the side of a plow blade. One example of such a device is shown in U.S. Pat. No. 4,707,936 to Steinhoff. These devices have the disadvantage of requiring the operator of the plow to exit the vehicle in order to bolt on or to position the sides when switching from plowing mode to pushing mode and visa versa. This deficiency results in a waste of time and fatigue to the operator.

V shaped plows such as the power V plow are yet another type of device that can be used to aid in containing snow during plowing. These devices are capable of positioning a split plow blade so that it angles into a V shape to contain a greater amount of snow during use. This type of device is very expensive to purchase and to maintain. These devices are also known to have inherent structural problems which cause a high break down frequency and a short useful life. Further, a power V plow does not clean the plowed surface as thoroughly as a straight blade angle-plow. Moreover, when the power V plow is maneuvered into its containment position with the open part of the V facing forward, the effective width of the plow is narrowed, thus greatly reducing the amount of snow being relocated.

Therefore, a new snow management device is needed for quickly and efficiently containing and relocating large quantities of snow that also allows for the same vehicle to quickly transform between a pusher box vehicle and an angle blade vehicle without requiring the operator to leave the driver's compartment. Moreover, a device is needed that is effective, allows for efficient transport of large amounts of snow, is easy to use, is structurally sound, simple, and which overcomes the problems experienced in past methods and devices aimed at snow removal. The present invention meets these needs.

SUMMARY OF THE INVENTION

The present invention relates generally to a snow pusher device that can be coupled to the plow blade of a work vehicle. A snow pusher according to the present invention involves a simple attachment to a straight blade snow plow which temporarily converts the plow into a pusher box for the purpose of containing the snow against the plow without lateral spillage. The invention generally concerns a two-sided apparatus that is capable of attachment to the plow.

The invention is made up of a snow plow pusher box comprising a pair of panels located at the ends of snow plow blade of a work vehicle, a support assembly containing at least one horizontal beam member joining the pair of panels together, a pair of brackets attached to the snow plow blade, and a pair of cam hooks which are affixed to the support assembly and releasably attached to said pair of brackets when in use.

The invention will be used primarily in the context of loaders, (front end loaders, trucks, tractors, and skid steer loaders). Attachment of the snow pusher to the plow does not require the operator to exit the vehicle. The snow pusher allows the operator to quickly and safely switch from plowing to pushing and visa versa many times during a given operation. This versatility increases the productivity and profitability of the snow removal process. The snow pusher is compact in size and easily transported from site to site.

The foregoing features, objects and advantages of the invention will become apparent to those skilled in the art from the following detailed description of a preferred embodiment, especially when considered in conjunction with the accompanying drawings.

DESCRIPTION OF THE PREFERRED EMBODIMENT

Figure 1:
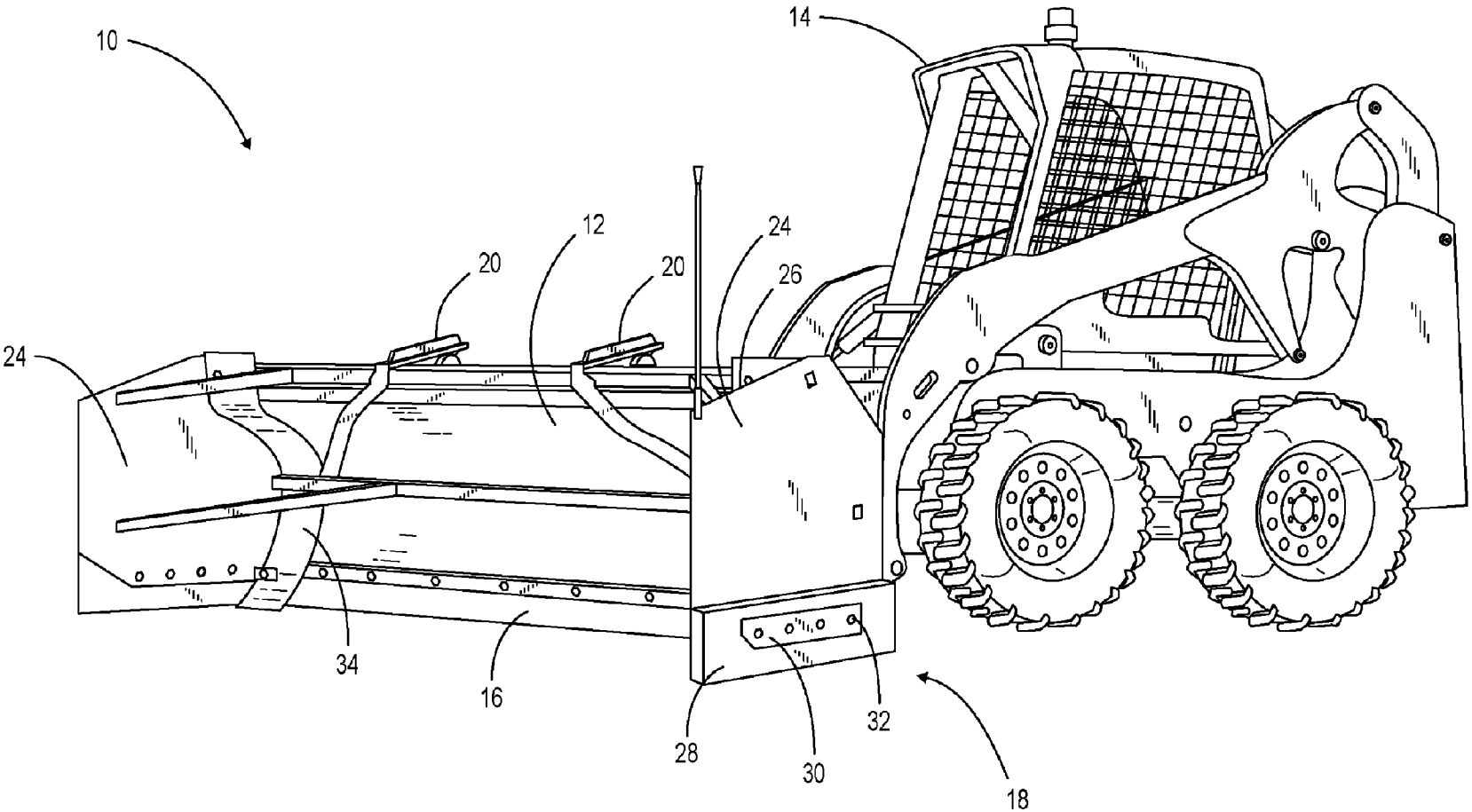
FIG. 1 is a perspective view of the snow pusher of the present invention attached to a work vehicle.

The present invention generally includes a snow plow pusher 10 which is attached to a straight plow blade 12 of a work vehicle 14. Suitable work vehicles with mounted plows may include but are not limited to skid steer vehicles, front end loaders, trucks, tractors, etc. The plow blades 12 to which the assembly attaches may include a variety of different blades made by different manufacturers. Suitable blades typically do however make use of a trip edge mechanism 16 located along the bottom blade surface for safety. Such a device will bend backwards against a spring mechanism if met by an obstruction on the surface being plowed.

The snow pusher is largely made up of a main body 18 which is attached to the plow blade 12 by engagement of a pair of its J cam hooks 20 and a pair of brackets 22. Where brackets 22 are bolted to the snowplow blade 12. When the arrangement is attached as shown in FIG. 1, the snow plow work vehicle will be capable of moving large amounts of snow greater distances that a typical plow blade due to the unique features of the plow vehicle that results.

Figure 2:
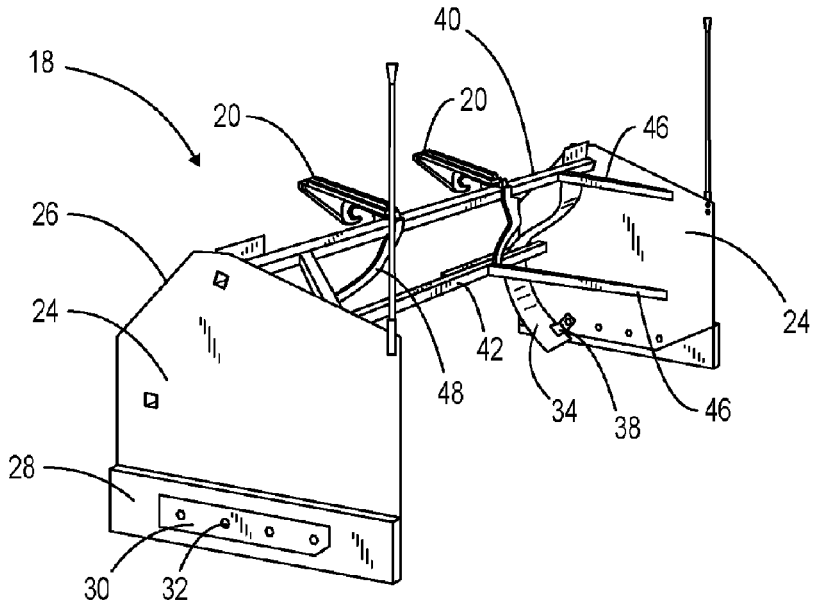
FIG. 2 is a perspective view of the main body of the snow pusher.

As seen in FIG. 2, the main body 18 of the snow pusher is largely made up of two plate-like side panels 24 joined together by a plurality of horizontal bars and cross members. The panels 24 may be made of metal, polymers, plastic, or aluminum. The panels 24 have flat surfaces which are generally perpendicular with respect to the horizontal plane of the ground. The two panels 24 are displaced from one another in a corresponding parallel manner such that they are similarly oriented and aligned. Panels 24 are located on either side of a plow blade 12 when in use. The surface of panels 24 are therefore able to deflect and contain plowed snow that might escape from either end of the blade. The panels 24 can be seen to have a perimeter of angled edges 26 to maximize effectiveness in plowing through and containing snow. The angled edges 26 also are contoured to generally reflect the shape of the plow to assist in reducing excess snow build up. The panels 24 are also elevated slightly from the ground by a pair of skid plates 28 positioned below and to the outer side of the panels 24. The plates 28 are made of replaceable material intended to wear during normal use. Using such material helps accommodate the uneven surfaces which are being plowed. Also found on the outside surfaces of the plates 28 are outer plate members 30. Outer plate members 30 are generally flat horizontal bars joined to the sides of the plates 28. The plates 28 and the outer plate members 30 are attached to the panels 24 via bolts 32 which pass through outer plate members 30, the skid plates 28 and panels 24. Various other well known methods of attaching the plates to the panels are contemplated by this invention as well.

Figure 3:
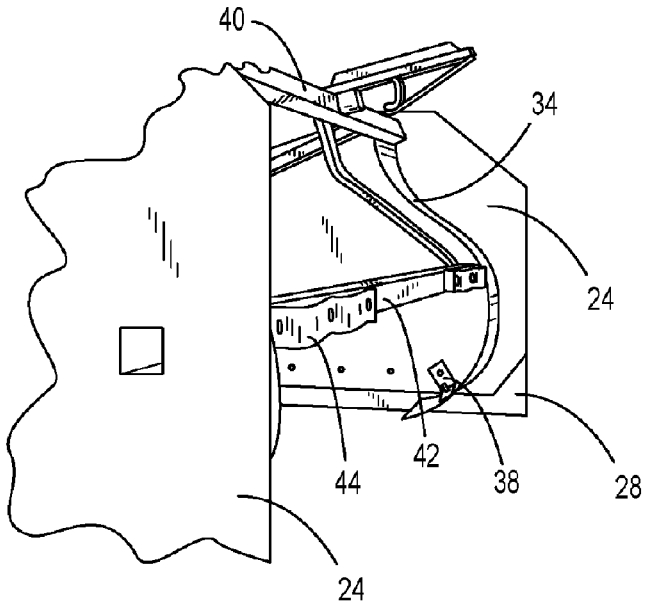
FIG. 3 is a rear perspective view of the main body of the snow pusher.

Formed within the inside surface of both panels 24 is a seal member 34. These members 34 are made of a strip of flexible material that sits against the flat inside edge of panel 24 in perpendicular relation. The flexible material curves from the top of the panel 24 to the bottom edge of the panel. Seal member 34 protrudes a short distance inward from either plate end toward the center of the device. See FIG. 3. The seal's flexible material is attached to the horizontal beams between the panels 24 as well as to an angle bracket 38 at the bottom of the panel 24. The flexible material of seal member 34 simulates the contour of the moldboard of the snowplow blade to which it attaches. This seal member 34 closes the gap between the side panels 24 and each end of the snow plow blade 12. Accordingly, a seal member 34 will not allow snow to pass through a gap between the plow blade 12 and side panel 24. Alternatively, a seal member could also be used which was not flexible, but was formed to prevent the passage of snow between the plow blade 12 and side panel 24.

Figure 4:
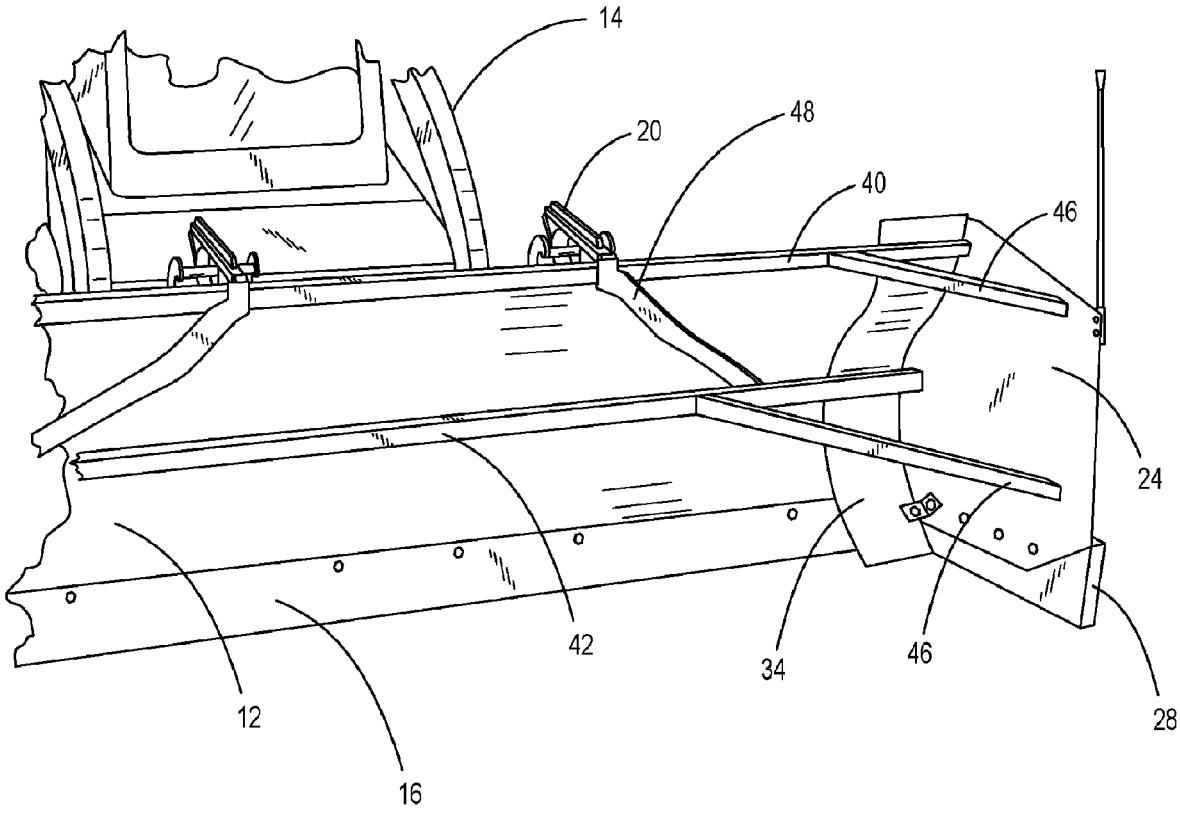
FIG. 4 is a side perspective view of the snow pusher where the plow blade and pusher are fully engaged.

As seen in FIG. 4, the two side panels 24 are connected by two beams 40 and 42. These beams are positioned in a perpendicular orientation with respect to the side panels 24 to join these similarly aligned plates. Upper beam 40 extends between the tops of the plates 24 and the second lower beam 42 extends between locations found midway down the face of the plates 24. The beams 40 and 42 may be made of metal or other suitable material and are welded to the plates 24 at both ends. Alternatively, the plates 24 may be rigidly joined to the beams 40 and 42 with bolts or other attachment devices (not shown) for easy disassembly for replacement of a bent or damaged side plate 24.

While only two horizontal brace members are disclosed in this embodiment of the present invention, a design with a greater or lesser number of horizontal support beams is also contemplated. Cushion material 44 is mounted on the rear facing side of the lower beam 42 to provide padding between the mold board making up the face of the plow blade 12 and the lower beam 42. See FIG. 3. This cushion 44 is useful as the lower beam 42 generally takes the brunt of the pushing force and directs it into the curvature of the mold board of the plow.

Six diagonal brace members provide further support for the body member of the snow pusher. Four of these are side brace members 46. Each of these members extends from locations on beams 40 and 42 which are inset a short distance from one of the four ends of the respective beams. The second end of these side brace members 46 is joined to a location near the front edge of the respective adjacent side panel members 24. These four diagonal side brace members 46 thereby form structural supports for reinforcing the rigidity of the pusher. Two additional diagonal braces 48 extend from the lower beam 42 to the upper beam 40 to attach with and support these members. These diagonal brace members 48 may also be referred to as cross members. These cross members are not straight, but rather are bent or contoured to accommodate the shape of the plow blade and pusher. Also, a design utilizing a greater or lesser number of diagonal support beams than disclosed is also contemplated without departing from the scope of the invention.

Figure 8:
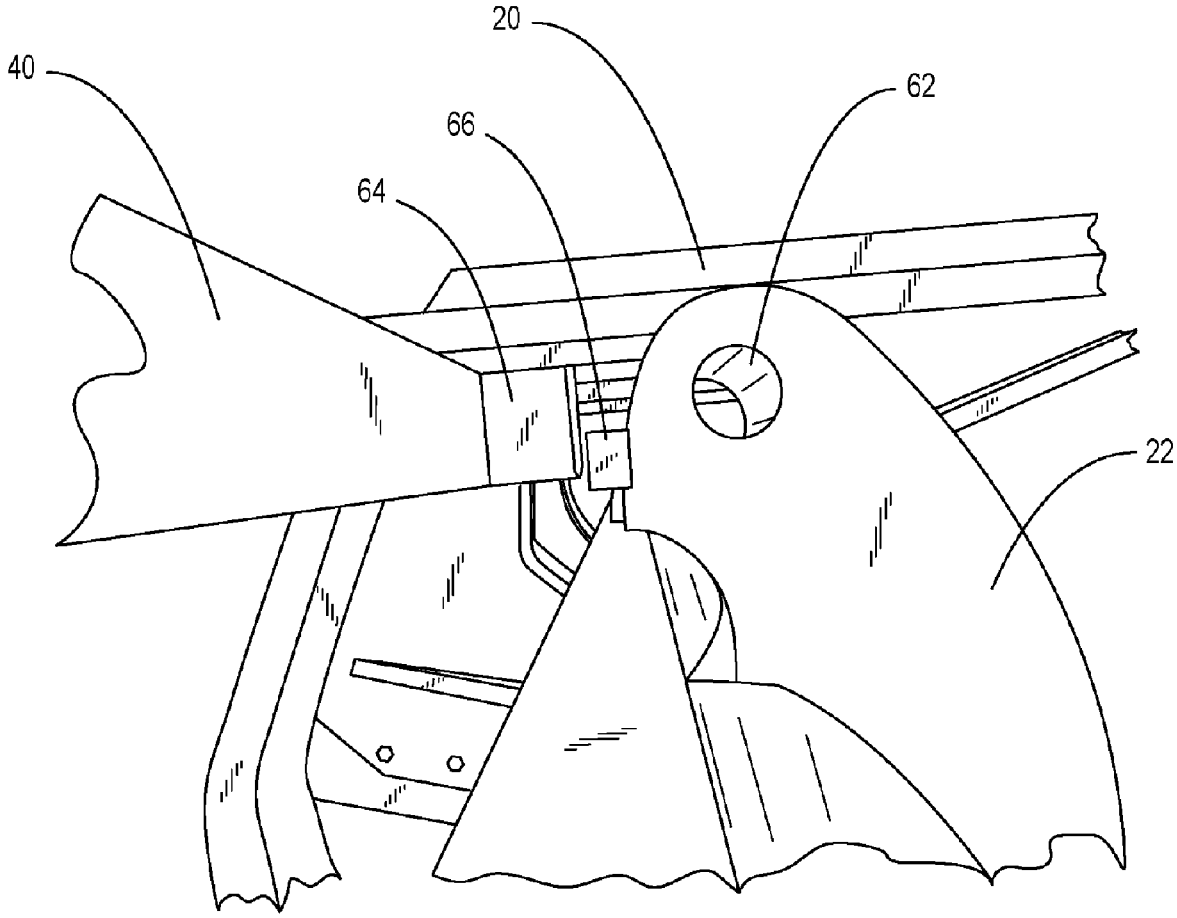
FIG. 8 is a side perspective view of an engaged hook and bracket assembly of the snow pusher.

A pair of J cam hooks 20 are also integrally connected to the top beam 40. Each of these J cam hooks 20 projects rearwardly from the top beam 40. The resulting hooks extending toward the plow 12 attached to work vehicle 14 that engages the snow pusher. The side surfaces of the J cam hooks 20 are positioned parallel with side panels 24, and the top surfaces are angled up towards the rear in relation to the ground. Additionally, the lower sloping surface 52 of each cam hook has an opening 54 in which a bracket may be placed to join the plow and pusher. Also, integrated into the J cam hook 20 is the cam stop 64 which is the stop mechanism to prevent detaching of the pusher while in use. See FIG. 8. This type of arrangement allows for easy alignment when connecting the snow pusher body 18 and plow blade 12. The upper beam 40 and attached J cam hooks 20 keep the apparatus in position on the plow when the snow pusher is in use. Therefore, the J cam hooks, forces exerted by work vehicle movement, and gravity are the means by which the snow pusher is kept in position during normal operation.

Corresponding to the pair of J cam hooks 20 are a pair of brackets 22 which are mounted to the top of the back surface of the plow blade 12. These brackets 22 are bolted to the plow blade such that they are located in equal spaced apart relation with respect to the center of the blade. The brackets 22 are formed such that they have a curved base plate 58 having a radius bend simulating the curvature of the moldboard of the plow to which it is attached. From that base extend two curved vertical plate members 60 that reach a height slightly above the top of the plow blade 12. Joining each of the pairs of vertical plate members 60 is a horizontal cam bar 66 and a shaft or pipe 62. It is these shafts 62 to which the J cam hooks 20 are joined and that enable pivotal latching by this invention.

Alternatively, it is also contemplated by this invention to use vertical plate members 60 which are not attached to the curved base plate 58, but rather are integrally formed directly with the plow blade. Forming the vertical plate members 60 with the plow could be done by welding or during manufacture of the plow blade. Attachment of the vertical plate members 60 in this way would eliminate the need to bolt a curved base plate 58 to the plow. Moreover, it is also within the scope of the present invention to use bracket and hook members attached in an opposite configuration to the one shown in the figures. For example, the hook members may be rigidly attached to the blade of the plow and the bracket members may be rigidly attached to the support assembly. Such modifications would allow for a similar manner of releasable attachment and do not depart from the teaching of this invention.

Further, although only a pair of J-cam hooks 20 and a pair of corresponding brackets 22 is shown in this embodiment, using additional hooks and brackets for support is also contemplated by the present invention. For example, using three or more J-cam hooks 20 and corresponding brackets 22 may be necessary in designs with particularly large plow attachments or for designs seeking to be more integrally connected to the plow blade.

Figure 5:
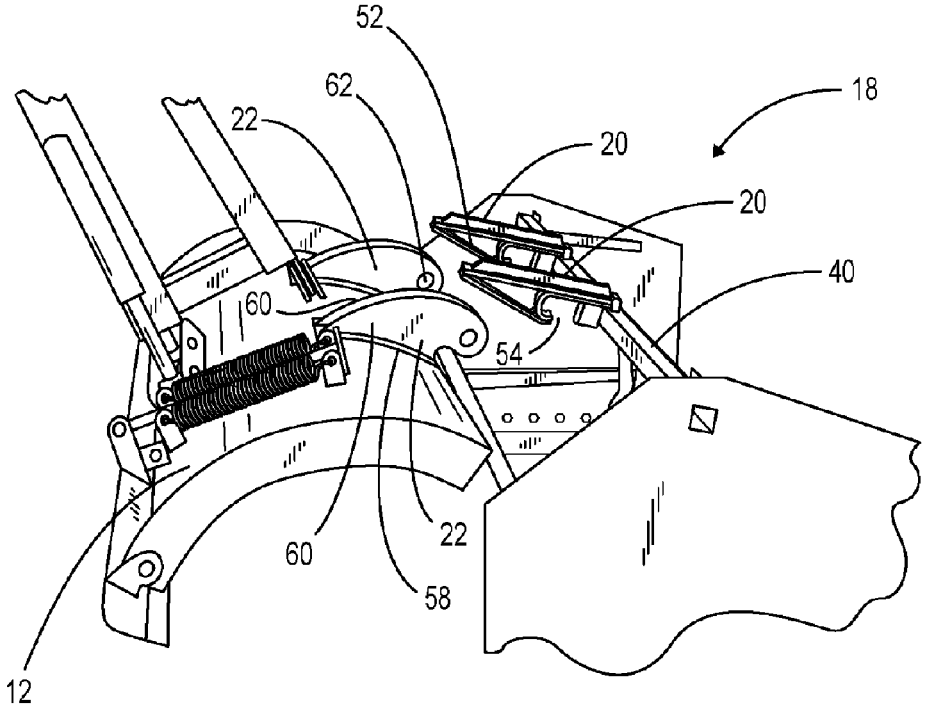
FIG. 5 is a side perspective view of the main body of the snow pusher unattached to the brackets on the plow.
Figure 6:
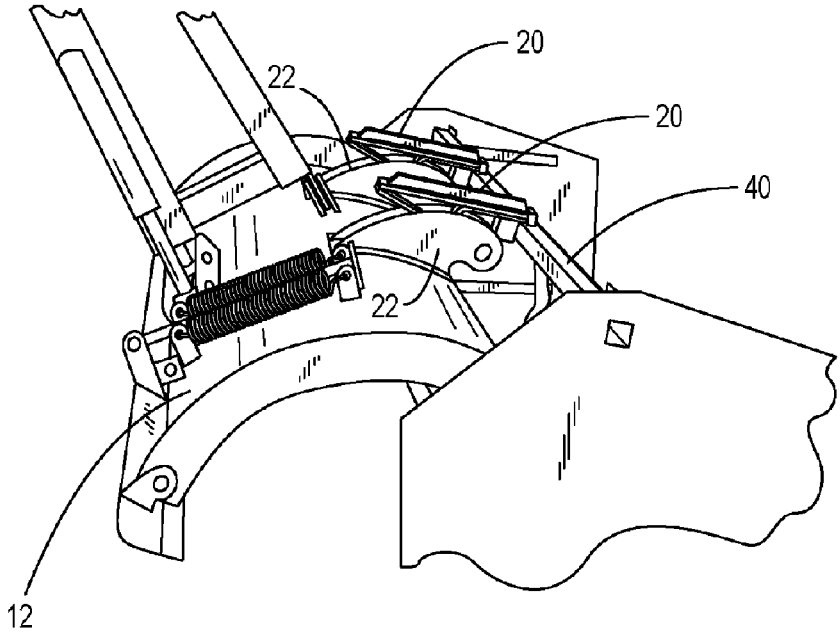
FIG. 6 is a side perspective view of the snow pusher with the brackets aligned for engagement with the hooks of the snow pusher.
Figure 7:
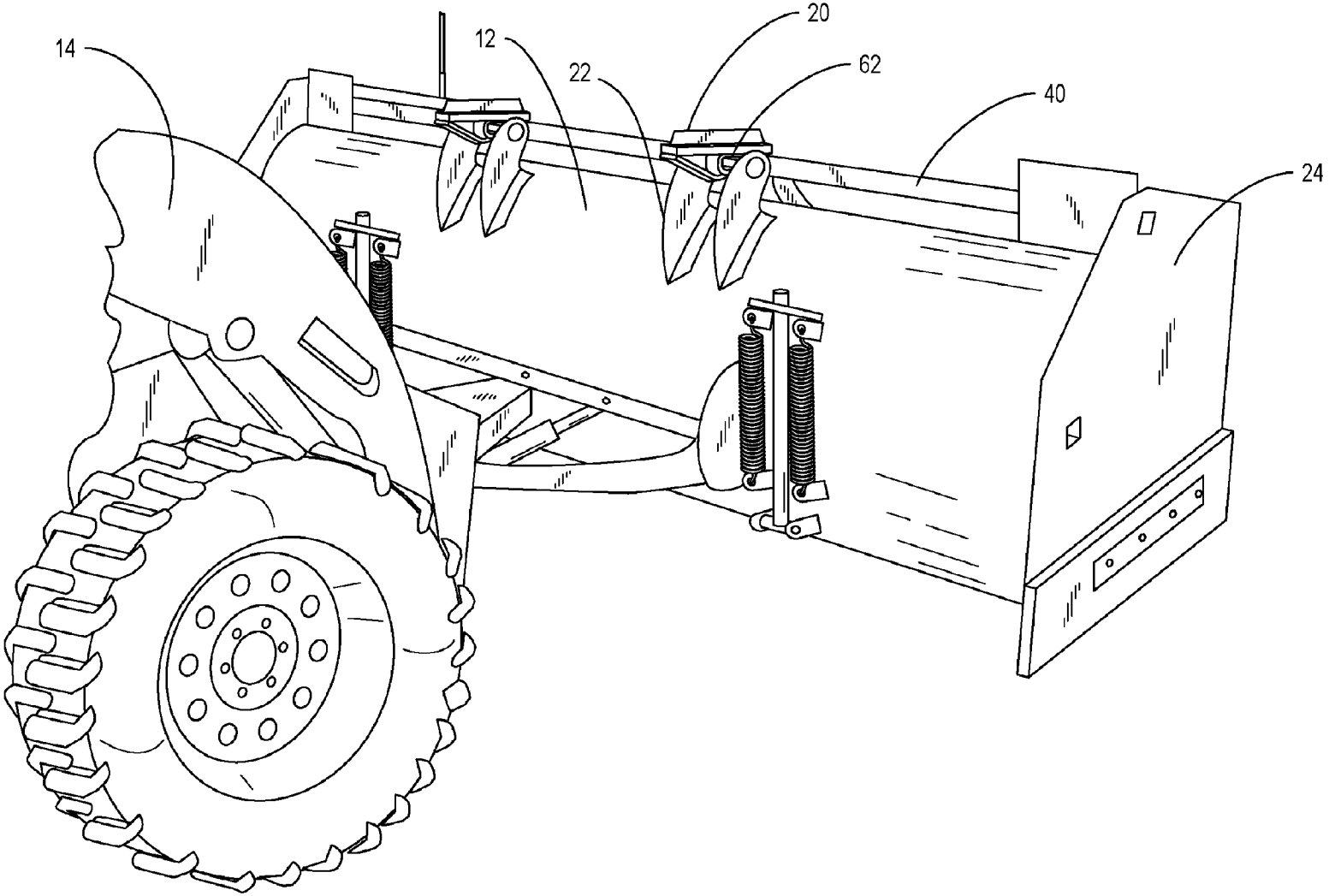
FIG. 7 is a side perspective view of the snow pusher where the brackets on the plow blade are fully engaged with the hooks of the snow pusher.

The method by which the J cam hooks 20 and plow blade 12 connect with the brackets 22 can be seen in FIGS. 5-7. Initially the plow blade 12 and mounted brackets 22 are separate from the J cam hooks 20 and the main body of the pusher 18. First, an operator tips forward the plow blade 12 of his work vehicle 14 such that the blade face is roughly parallel to the plane of the ground, as seen in FIG. 5. Next, the operator moves the work vehicle and plow forward to align the brackets 22 with the openings 54 in J cam hooks 20, as seen in FIG. 6. Next, the operator rotates the plow blade 12 back into a plowing position where the plow blade is roughly perpendicular with the ground, as seen in FIG. 7.

As disclosed, the bracket members 22 generally are joined in such a way that they are hooked and then rotated until the cam bar 66 of the bracket meets the cam stop 64 (i.e. brace member) of the hook. See FIG. 8. This configuration prevents the snow pusher from becoming disconnected unless the operator reverse rotates, or tilts the plow to the ground. If an operator were to conduct such a reverse rotation maneuver, the cam bar 66 of the bracket 22 would be drawn away from the cam stop of the hook allowing the shaft 62 of the bracket 22 to be removed from the J cam hook 20 and thereby disconnect the snow pusher body 18 from the snow plow 12.

Therefore, operation of the snow plow pusher device to clean an area containing a road and intersecting driveways is as follows. First, the work vehicle utilizes the plow blade 12 of his or her vehicle to back drag snow from the various driveways onto the main road. This is done with a work vehicle 14 using a plow blade 12 with the bracket members 22 attached to its rear surface. No substantial interference to normal plow operation is caused by brackets 22. Next, an operator loads the body 18 of the snow pusher device onto the plow blade 12 by driving up to the main body 18 of the pusher, rotating the plow blade such that its face is roughly parallel to the plane of the ground, and driving the vehicle forward until the pipes 62 of the brackets 22 mounted on the plow align with the openings 54 in the J cam hooks 20.

Next, the plow blade 12 is rotated such that the blade is roughly perpendicular to the ground in a normal plowing configuration, and such that the main pusher body 18 is securely attached to the snow plow blade. The operator next drives the vehicle down the main road where the snow has accumulated. Because of the attachment of the pusher member a large amount of snow is able to be pushed down the road to a desired location very quickly and with relatively few passes. Further, because the plow blade retains the ability to angle itself with the pusher member attached, greater versatility and effectiveness of use is retained with the new device. And furthermore, with the pusher member attached, the trip edge mechanism 16 on the plow blade retains its full range of motion, thus retaining the safety feature for which the trip edge was intended. When areas along the road and driveway need touch up work or additional plowing the main pusher body 18 can easily and quickly be removed. The operator may do this by rotating the plow blade forward until the blade is roughly horizontal and the pusher attachment drops out of the J cam member 20. The attachment can be left in any convenient location and the work vehicle can leave to perform work with the plow blade on its own. This configuration and attachment method allows the quick and repeated conversion of a snow plow into a snow pusher box and visa versa. Clearing snow from a location in this way results in an area where snow has been rapidly removed and transported in an efficient manner without requiring the operator to leave the cab of his or her work vehicle.

Those skilled in the art will appreciate that the snow pusher of the present invention may be manufactured in a variety of shapes and sizes to accommodate various sizes and types of work vehicles, plow blades, and work vehicle attachments. The invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention itself.

What is claimed is:

1. A dual wing snow pusher attachment for a work vehicle snow plow blade of a work vehicle comprising:

(a) a pair of spaced side panels designed to be positioned and to extend forward from opposite ends of a snow plow blade for capturing and moving snow therebetween;

(b) a support assembly comprising at least one horizontal beam member spacing and joining the pair of spaced panels together;

(c) a pusher attaching assembly comprising a plurality of spaced brackets, said brackets each supporting a generally horizontally disposed attachment member; and (d) a plurality of spaced cam hooks capable of alignment and releasable engagement with the shafts of said plurality of brackets by operator manipulation of the snow plow blade from within the cab of the work vehicle, wherein said brackets are substantially wider than said cam hooks to facilitate alignment of said pusher attachment and a plow blade.

2. A snow pusher as in claim 1 wherein said brackets are attached to a plow blade.

3. A snow pusher as in claim 1 wherein the panels are provided with removably attached replaceable skid plates.

4. A snow pusher as in claim 2 wherein the panels are provided with removably attached replaceable skid plates.

5. A snow pusher as in claim 1 further including a pair of spaced contoured seal members attached to and extending from said side panels for covering gaps between the side panels and corresponding ends of an associated snow plow blade.

6. A snow pusher as in claim 4 further including a pair of spaced contoured seal members attached to and extending from said side panels for covering gaps between the side panels and corresponding ends of an associated snow plow blade.

7. A snow pusher as in claim 1 wherein the cam hooks are J-shaped.

8. A snow pusher as in claim 1 wherein said support assembly includes a pair of diagonal, forward directed support beams joining each said horizontal beam member to said pair of panels.

9. A snow pusher as in claim 6 wherein said support assembly includes a pair of diagonal, forward directed support beams joining each said horizontal beam member to said pair of panels.

10. A snow pusher as in claim 1 wherein each of said side panels is removably attached to facilitate replacement thereof.

11. A snow pusher as in claim 10 wherein the panels are provided with removably attached replaceable skid plates.

12. A snow pusher for releasable attachment to the snow plow blade of a work vehicle comprising:

(a) a pair of spaced generally planar, generally vertically oriented panels of similar shape, said panels being provided with removably attached replaceable skid plates;

(b) a support assembly containing at least one horizontal beam member extending between and joining the pair of panels together across a width dimension of a plow blade, said panels and support assembly adapted to wrap around the sides of a snow plow blade;

(c) an attachment assembly that allows releasable attachment of said snow pusher affixed to a snow plow blade by rotation of said snow plow blade comprising a plurality of generally horizontally disposed shaft members and corresponding hook members mounted to engage said shaft members for releasably joining said plow blade to said snow pusher; and (d) a pair of members contoured to cover any gaps between the panels and the snow plow blade to prevent snow from passing through said gaps.

13. A snow pusher as in claim 12 wherein said support assembly includes a plurality of vertically spaced horizontal beam members joining said first panel and said second panel.

14. A snow pusher as in claim 13 wherein said support assembly includes a pair of diagonal, forward directed support beams joining each said horizontal beam member to said pair of panels.

15. A snow pusher as in claim 12 wherein each of said side panels is removably attached to facilitate replacement thereof.

* * * * *